US006213314B1

(12) United States Patent
Beemer

(10) Patent No.: US 6,213,314 B1
(45) Date of Patent: Apr. 10, 2001

(54) PORTABLE RACK FOR GARDEN TOOLS

(76) Inventor: Richard G. Beemer, 5327 W. 200 N., Huntington, IN (US) 46750

( * ) Notice: Subject to any disclaimer, the term of this patent is extended or adjusted under 35 U.S.C. 154(b) by 0 days.

(21) Appl. No.: 09/593,389

(22) Filed: Jun. 14, 2000

Related U.S. Application Data

(60) Provisional application No. 60/156,698, filed on Sep. 30, 1999.

(51) Int. Cl.[7] ..... A47F 5/00

(52) U.S. Cl. ..... 211/70.6; 211/205; 211/65; 248/156

(58) Field of Search ..... 211/70.6, 205, 211/64, 70.2, 65, 204; 248/156

(56) References Cited

U.S. PATENT DOCUMENTS

| | | | | |
|---|---|---|---|---|
| 96,484 | | 11/1869 | Roux . | |
| D. 184,592 | | 3/1959 | Vetter . | |
| D. 299,805 | * | 2/1989 | Pifher . | |
| D. 377,310 | | 1/1997 | Crump, Jr. . | |
| 1,150,256 | | 8/1915 | Dunbar . | |
| 1,208,923 | * | 12/1916 | Dell . | |
| 1,259,623 | * | 3/1918 | Herrick . | |
| 3,069,021 | | 12/1962 | Gray . | |
| 3,074,674 | * | 1/1963 | Hill . | |
| 3,076,557 | | 2/1963 | Husted et al. . | |
| 3,143,817 | * | 8/1964 | Paulson . | |
| 3,170,612 | | 2/1965 | Blumenschein . | |
| 3,255,986 | * | 6/1966 | Eadie . | |
| 4,467,925 | | 8/1984 | Ratzloff et al. . | |
| 5,080,239 | | 1/1992 | Rowland . | |
| 5,636,754 | | 6/1997 | Ennis . | |
| 5,755,342 | * | 5/1998 | Hoffman | 211/64 |
| 5,819,462 | * | 10/1998 | Dockery | 211/64 X |
| 6,035,572 | * | 3/2000 | Goode . | |

FOREIGN PATENT DOCUMENTS

| | | |
|---|---|---|
| 298715 | 7/1954 | (CH) . |
| 142779 | 3/1902 | (DE) . |
| 2273039 | 6/1994 | (GB) . |

* cited by examiner

*Primary Examiner*—Robert W. Gibson, Jr.
(74) *Attorney, Agent, or Firm*—Richard C. Litman

(57) ABSTRACT

A portable rack for garden tools provides support for various garden tools during gardening and light landscaping operations. The present rack is particularly well suited for the support of the upper ends or handles of larger elongate tools, such as shovels, rakes, hoes, etc., with the lower working ends of the tools remaining on the ground. The gardener thus need not bend over or stoop to pick up such a tool from the ground each time a different tool is needed. The present rack essentially comprises a central column with a sharpened lower end to facilitate ground penetration. A laterally extending spade or blade bit is provided above the lower end, which precludes rotation of the central column within the hole formed in the ground when the device is anchored. A lower foot planting crossmember is provided above the spade or blade, for the gardener to plant the device into the ground in the manner of using a shovel or spade. An upper, tool rest crossmember extends across the central column near the upper end thereof, with the tool rest crossmember having a series of spaced apart pins or fingers extending laterally therefrom and defining a series of tool rest positions therebetween. A top crossmember may also be provided, for suspending or supporting additional articles therefrom as desired. The present portable rack is preferably constructed as a rigid, unitary structure, by welding solid steel rod bar stock components together. Alternative materials may be used as desired.

18 Claims, 3 Drawing Sheets

PORTABLE RACK FOR GARDEN TOOLS

REFERENCE TO RELATED PATENT APPLICATION

This application claims the benefit of U.S. Provisional Pat. application Ser. No. 60/156,698, filed on Sep. 30, 1999.

BACKGROUND OF THE INVENTION

1. Field of the Invention

The present invention relates generally to racks, stands, and supports for temporarily holding or supporting various articles, and more specifically to a portable rack for temporary penetration of the ground for leaning, resting, and/or suspending various garden tools and accessories therefrom. The present rack is constructed as a rigid, unitary structure, and includes means for precluding rotation in the event that laterally asymmetric loads are placed upon the device.

2. Description of the Related Art

Gardening and relatively light duty landscaping activities are popular hobbies with many homeowners, and in fact some amount of such work is a nearly universal requirement for all homeowners. Such work generally involves the use of small trowels and other relatively small hand tools and accessories, and also often requires larger, longer handled tools, such as shovels, rakes, hoes, edgers, etc., depending upon the specific task(s).

Most people will require several different tools during any given gardening session, as it is a rare occasion that the time is spent solely on a single type of operation (e.g., digging and spading, or raking, etc.). Most gardening activities will require several different tools to be used during the operation, with the gardener alternately setting one tool aside and picking up another according to the specific operation being performed. This is not a particularly arduous procedure for operations with relatively small hand tools, as the gardener is generally upon his/her hands and knees anyway, and such small tools may be set aside within arms reach as needed.

However, where larger tools (shovels, rakes, hoes, etc.) are used, the gardener remains standing. Yet, the tools must be placed upon the ground unless there is some convenient structure against which the tools may be placed. This is often not the case unless one is working along a fence or the wall of a house or the like. In a garden, there are often no structures whatsoever against which such tools may be temporarily placed until needed, thus requiring the gardener to stoop and bend each time a different larger tool is needed. The repeated stooping and bending to set aside and pick up different tools during the course of a gardening session can prove to be rather arduous, and in fact may account for a large part of the back strain and discomfort which may be experienced by gardeners after a session working in their flower beds, gardens, etc.

Accordingly, a need will be seen for a portable rack or rest for temporarily supporting various larger hand tools as commonly used in gardening and manual landscaping operations, for precluding any requirement for the gardener to bend and stoop to pick up such tools. The present rack comprises a central column with at least two crossmembers rigidly and immovably secured thereto. The lower crossmember serves as a planting device upon which the gardener may step to plant the rack temporarily into the ground, while at least one upper crossmember includes a plurality of lateral fingers or extensions defining a series of tool handle rests therebetween. The lower end of the central column includes a spade or blade extending laterally therefrom, which precludes the rotation of the rack within its hole in the ground when asymmetric loads are placed upon the tool rest crossmember. The present rack may be formed in any suitable dimensions to support larger or smaller tools.

A discussion of the related art of which the present inventor is aware, and its differences and distinctions from the present invention, is provided below.

U.S. Pat. No. 96,484 issued on Nov. 2, 1869 to Benoit Roux, titled "Shovel Stand," describes a device for indoor use for holding a relatively small shovel and other utensils for use in a fireplace or the like. As such, no means is provided for embedding the device in the ground, as provided by the present invention. Moreover, the Roux stand is disassembleable, unlike the unitary construction of the present invention, and the Roux stand is limited to holding only two tools.

U.S. Pat. No. 1,150,256 issued on Aug. 17, 1915 to Oris K. Dunbar, titled "Display Rack," describes a disassembleable stand having a series of support legs into which a vertical column is threaded. No means of planting the device in the ground is provided. The upper end has a detachable circular rack thereon, for removably holding a variety of different implements. The implements are not leaned against the upper rack, as no means is provided to prevent such implements from falling over laterally. In contrast, the present invention includes a series of tool handle rests, in which the elongate handles of the tools may be leaned for ease of retrieval as desired.

U.S. Pat. No. 3,069,021 issued on Dec. 18, 1962 to Ruth C. Gray, titled "Garment Drying Apparatus," describes a folding, generally circular clothes drying rack having a series of radially disposed legs for support atop a surface, and another series of radially disposed arms surrounded by a peripheral clothesline. The radial arms and surrounding clothesline do not define any tool handle rests therealong, and a tool which was leaned against such a device would fall over laterally unless carefully positioned. Moreover, the Gray clothes rack does not penetrate or anchor into the ground, and may be folded and disassembled, unlike the unitary, monolithic construction and ground penetration anchoring of the present invention.

U.S. Pat. No. 3,076,557 issued on Feb. 5, 1963 to Ralph Husted et al., titled "Portable, Foldable Support," describes a T-shaped device having a lower ground penetrating spike and a pair of folding upper lateral arms. Husted et al. provide hooks depending from the bottoms of the folding arms for hanging the handle or bale of a lantern or the like therefrom. However, no laterally extending fingers or pins are disclosed for defining a series of tool handle rests therebetween, as in the present portable rack invention.

U.S. Pat. No. 3,170,612 issued on Feb. 23, 1965 to Gordon Blumenschein, titled "Garden Tool Holder," describes a device having a single rod element with a ground penetrating spike and lateral offset for planting the device in the ground. The tool holder is removably installed in the upper end of the rod. by a spring or the like surrounding the upper end of the rod, with an extension of the holder placed within the spring coils. This allows the tool holder(s) to rotate axially about the rod if an asymmetric load is placed thereagainst, as by one or more tool handles being leaned against the holder(s). Moreover, no spade or blade elements extend laterally from the ground penetrating spike of the rod. This allows the rod to rotate relatively easily when an uneven lateral load is placed thereon. In contrast, the present rack is a rigid, unitary structure with lateral blades, and resists rotation due to any asymmetric loads which may be imparted thereto. Also, the Blumenschein holder is adapted only for hanging small hand tools therefrom (column 2, lines 49–51 of Blumenschein), rather than leaning larger tools thereagainst as in the present rack.

U.S. Pat. No. 4,467,925 issued on Aug. 28, 1984 to Harry Ratzloff et al., titled "Wheelbarrow And Garden Tool Storage Rack," describes a wall mounted rack for holding tools and a wheelbarrow clear of the floor. The Ratzloff et al. rack is generally T-shaped, but is secured to the wall of a structure, rather than penetrating the ground for support as in the present invention. Moreover, the Ratzloff et al. rack is adapted for suspending and completely supporting tools therein, rather than serving as a structure for leaning the tools thereagainst with the lower ends of the tools resting on the ground, as in the present rack invention.

U.S. Pat. No. 5,080,239 issued on Jan. 14, 1992 to Joseph W. Rowland, titled "Golf-Club Holder For Use With Golf Carts," describes a stake with a point for imbedding in the ground and an upper end having a series of short chains with rings secured to their distal ends. A golf club grip is inserted through the ring with the head of the club resting on the ground, with the limited length of the chain holding the club in a generally vertical orientation for ease of acquisition when desired The Rowland device does not possess unitary, rigid construction, as in the present rack invention, nor is it sufficiently tall as to provide a rest for longer handled tools. Moreover, Rowland does not provide a rigid, lateral arm extending across the top of the vertical stake for laterally supporting the handles of tools rested thereagainst, and in fact teaches away from such a structure due to the need for the device to fit compactly within a golf bag.

U.S. Pat. No. 5,636,754 issued on Jun. 10, 1997 to Lynwood P. Ennis, titled "Golf Club Stand Apparatus," describes a device related to that of the '239 U.S. Patent to Rowland discussed immediately above. The Ennis stand comprises a shaft with a pronged fork at the lower end thereof, for embedding in the ground. The opposite upper end of the shaft has a semicircular arm removably attached thereto. The grip or handle ends of golf clubs are leaned within the curved upper arm, with the club heads resting on the ground. The Ennis-club holder limits the number of tools or other elongate articles which may be held therein, and the pronged base does not provide the security against turning within the ground which the present laterally disposed blade or spade provides. The Ennis stand, with its assembly of parts, is relatively weak in comparison to the solid, unitary construction of the present tool holder.

U.S. Pat. No. D-184,592 issued on Mar. 10, 1959 to Lloyd E. Vetter, titled "Rack For Gardening Tools," illustrates a design formed of relatively thin, flat bar stock or the like. No lower lateral foot planting crossmember nor upper lateral tool rest crossmember is provided. Rather, two pairs of opposed loops formed of flat stock extend laterally across the main vertical member. A tool could not be merely leaned against the Vetter rack, due to the loops, but rather the tool handle would have to be inserted within one of the loops for the device to support the tool. This would require the tool to be lifted from the loop, rather than merely moved laterally away from the rack, as in the present rack invention.

U.S. Pat. No. D-377,310 issued on Jan. 14, 1997 to Jim C. Crump, Jr., titled "Tool Holder," illustrates a design having a flat plate for mounting atop a floor or other supporting surface, rather than being imbedded in the ground. A column extends upwardly from the plate, with a tray having opposed flanges extending therefrom being mounted atop the column. At least the lower mounting plate and the upper tray are formed of flat sheet material, with the tray being bolted to the upper end of the column. In contrast, the present rack is formed of unitary construction of bar stock or tubular materials and includes means for anchoring in the ground, unlike the Crump, Jr. design.

German Patent Publication No. 142,779 patented on Mar. 11, 1902 illustrates a device for anchoring in the ground, comprising a hollow tubular anchor which is imbedded in the ground with a shaft or rod inserted therein. A hollow upper tube having a pair of opposed arms is placed over the upper end of the rod, and is free to rotate on the rod relative to the ground anchor. A platform is disposed on one arm, with a counterweight on the other arm. The device cannot support a lateral load leaned against one of the arms, as the arms would rotate under such a load. No foot planting crossbar is provided, and no ground engaging spade or blade is provided, nor is one needed to prevent the ground engaging tube from rotating within the ground, as the upper portion of the device is free to rotate in any event.

Swiss Patent Publication No. 298,715 published on Jul. 16, 1954 illustrates a disassembleable device having a tubular member which clamps removably to a ground anchor portion. An upper horizontal member clamps removably to the upper end of the tube. No lateral fingers or pins extending from the upper horizontal member are apparent. It does not appear that the device of the Swiss '715 Patent Publication would be suitable for laterally resting the handle of an elongate tool thereagainst, as no means is apparent for preventing the handle of the tool from sliding laterally off the upper crossmember. The present tool rack differs considerably, due to its rigid, unitary construction, spade or blade member for imbedding in the ground to preclude rotation of the device, and fingers extending from the upper crossmember for holding objects leaned thereagainst.

Finally, British Patent Publication No. 2,273,039 published on Aug. 6, 1994 to Richard Conway, titled "Swivel Basket With Bracket Or Stand," describes a plant stand for either mounting on a wall or for floor support. Accordingly, no ground engaging anchor is provided. The upper portion of the device comprises a removable basket-like structure having a plurality of upwardly and radially extending fingers. The device of the '039 British Patent Publication would be unsuitable for use in leaning tools thereagainst, as the lack of ground penetration would allow the free standing device to tip easily.

None of the above inventions and patents, either singly or in combination, is seen to describe the instant invention as claimed.

SUMMARY OF THE INVENTION

The present invention comprises a portable rack for garden tools, for supporting the upper ends or handles of elongate tools (e.g., shovels, rakes, hoes, etc.) in a generally upright position during gardening, light landscaping, or related work. The present rack generally comprises a central column which is in a generally vertical position when in use. The lower end of the column is sharpened in order to facilitate penetration of the ground, for temporarily securing the device in the earth as desired. A laterally extending spade bit is provided just above the lower end of the column for embedding in the ground, with the spade precluding rotation of the column. A lower crossmember extends across the column above the spade bit, for planting the device using foot pressure on the crossmember.

An upper tool rest crossmember extends across the column near the upper end thereof, with the tool rest crossmember having a series of smaller spaced apart fingers or pins extending therefrom, either to one side or symmetrically to both sides of the crossmember. These fingers or pins define a series of tool rests therebetween, with the fingers precluding the tools from falling laterally from the rack when leaned thereagainst. Smaller pins or fingers may be used for hanging smaller articles (trowels, etc.) therefrom. A secondary top crossmember may also be provided above the tool rest crossmember, if desired, for use in hanging or suspending other articles (e.g., a shirt, cap, water jug, etc.) therefrom.

The present portable rack is preferably constructed of solid steel bar stock material, for durability. The various components comprising the present rack (i.e., central column, crossmembers, spade bit, and tool rest fingers) are preferably welded together to form a solid, unitary, monolithic structure with no disassembleable parts. Alternatively, other materials (e.g., pipe, etc.) may be used to construct the present rack, if so desired, and the device may be constructed to any practicable height as desired.

Accordingly, it is a principal object of the invention to provide an improved portable rack for garden tools generally comprising a central column which is generally vertically disposed when the device is anchored in the ground, with the central column including at least a lower foot planting crossmember and an upper tool rest crossmember extending thereacross.

It is another object of the invention to provide an improved rack for garden tools which lower end is sharpened to some degree for ease of ground penetration and which includes a laterally extending spade bit to preclude rotation of the central column in the event that asymmetrical lateral loads are placed thereon.

It is a further object of the invention to provide an improved rack for garden tools which tool rest crossmember includes a plurality of spaced apart fingers or pins extending therefrom, with the fingers or pins defining a series of tool handle rest positions therebetween.

An additional object of the invention is to provide an improved rack for garden tools including a secondary upper crossmember, if so desired, for the support of additional articles.

Still another object of the invention is to provide an improved rack for garden tools which is sturdily constructed as a rigid, unitary, monolithic device which cannot be disassembled.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
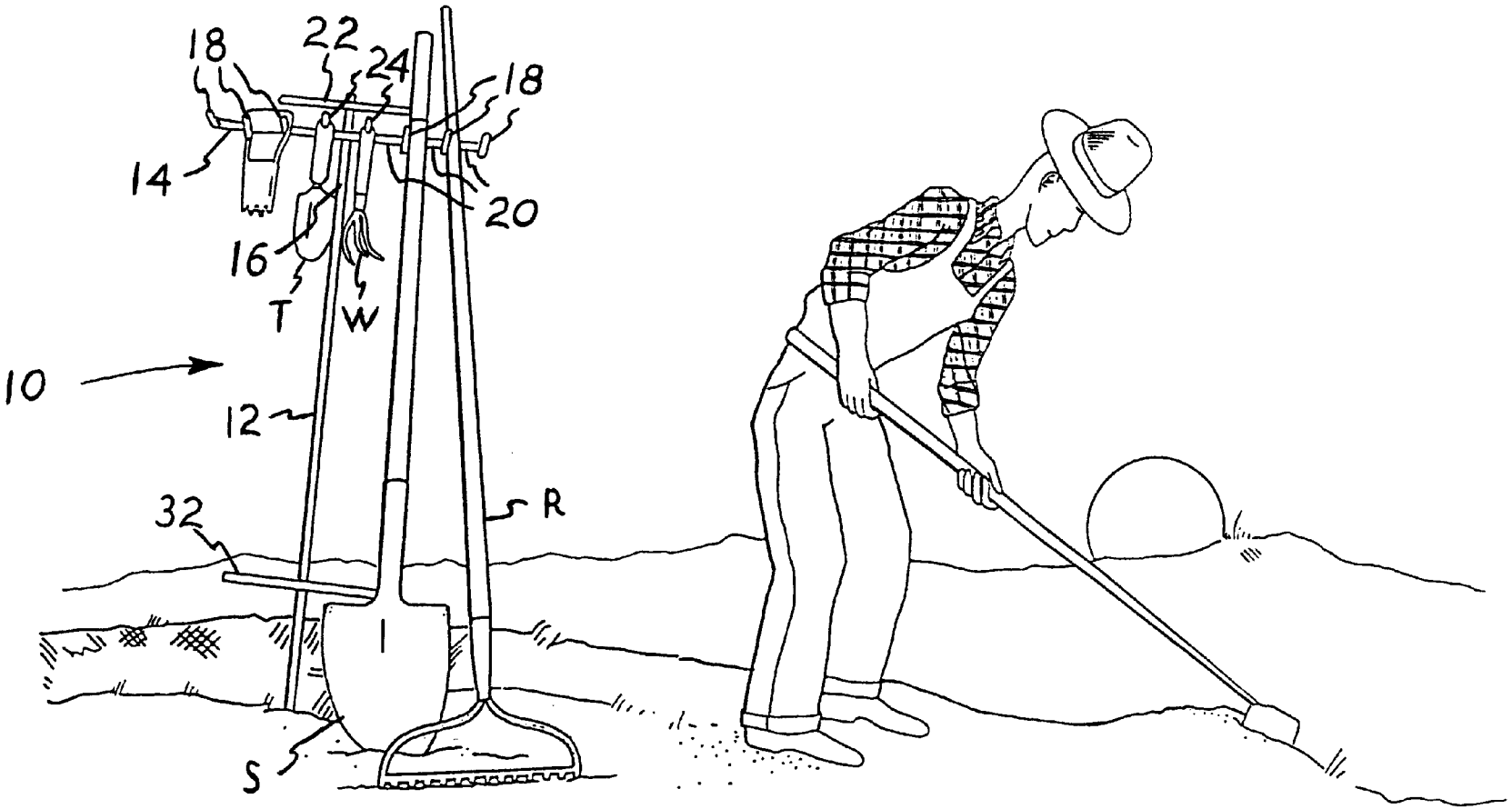
FIG. 1 is an environmental perspective view of the present portable rack for garden tools, showing its use and function.

The present invention comprises a portable rack or rest. for supporting garden tools and the like, with the use and operation of the present rack 10 being shown in FIG. 1 of the drawings. The present rack 10 generally comprises a rigid, straight central column 12 having a tool rest crossmember 14 permanently affixed across the upper portion 16 of the central column 12. The tool rest crossmember 14 extends laterally across the upper portion 16 of the central column 12, and is preferably symmetrically disposed.

The crossmember 14 includes a series of spaced apart tool rest fingers or pins 18 extending laterally therefrom, i.e., normal to the plane defined by the central column and crossmember. The tool rest fingers 18 define a corresponding series of tool rest positions 20 between each of the fingers or pins 18. The tool rest fingers 18 may extend to only one side of the crossmember 14, as shown in FIG. 1, or may alternatively extend generally symmetrically to each side of the crossmember 14 as shown by the tool rest fingers 18*a* of FIG. 3, to provide a series of tool rest positions 20*a* opposite the tool rest positions 20 of the rack 10.

A rigid, straight, elongate top crossmember 22 may also be optionally affixed to the upper portion 16 of the central column 12, above the tool rest crossmember 14. The top crossmember 22 is preferably affixed to the central column 12 so as to be coplanar with the underlying tool rest crossmember 14, and is preferably symmetrical relative to the central column 12, in the manner of the tool rest crossmember 14.

The tool rest crossmember 14 may also include one or more secondary support pins or fingers 24 extending therefrom, if so desired. These auxiliary pins or fingers 24 may be formed of smaller diameter material than the outer tool rest crossmembers 18 or 18*a*, and are particularly well suited for suspending smaller hand tools (a trowel T, weeding tool W, etc.) therefrom, as shown in FIG. 1 of the drawings. Such auxiliary pins or fingers 24 may be disposed between the outwardly positioned tool rest fingers or pins 18, or elsewhere along the tool rest crossmember 14, as desired, and may extend symmetrically across the tool rest crossmember 14 as secondary fingers 24*a*, as shown in FIG. 3 The outer tips may be angled upwardly, in order to preclude tools or objects sliding from the fingers 24*a*.

Figure 2:
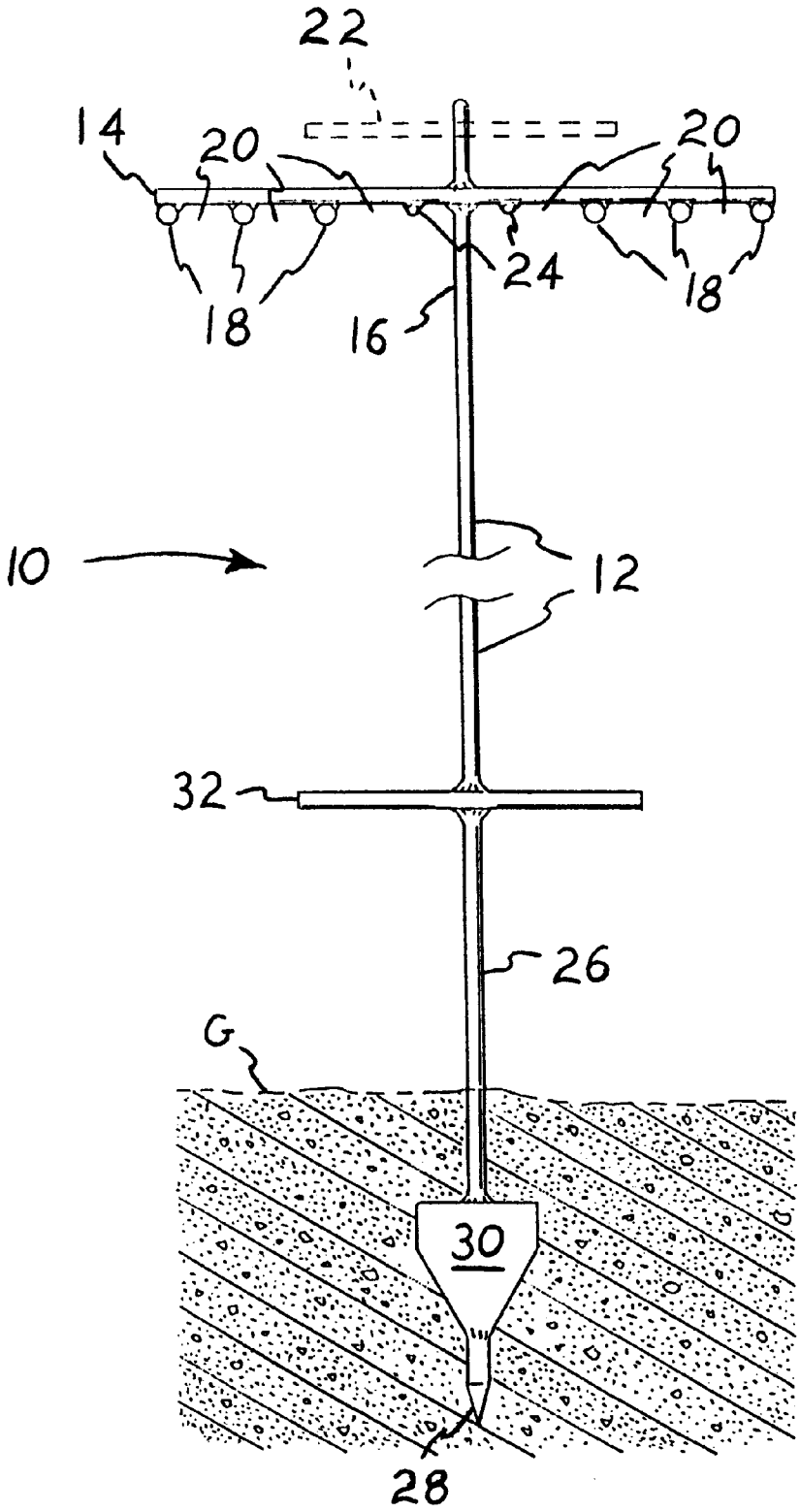
FIG. 2 is a front elevation view of the present garden tool rack showing further details thereof and means for anchoring in the ground.

The opposite lower portion 26 of the central column 12 is configured particularly for removably anchoring in the ground, as is shown clearly in FIG. 2 of the drawings. The lower end 28 of the central column 12 is sharpened (at least to some extent) in order to facilitate the penetration of the ground G for removably anchoring the present rack 10 in the ground for use. The lower portion 26 of the central column 14 may also include a laterally extending spade bit or blade 30 affixed thereto, above the lower tip or end 28. The flat, laterally extending spade or blade 30 which extends to each side of the central column 14, precludes any turning or rotation of the relatively narrow central column 14 in the ground G when asymmetric forces are applied to the crossmembers 14 and/or 22 of the rack 10, as discussed in detail further below.

A straight, elongate, rigid foot planting crossmember 32 is also rigidly and immovably affixed to the lower portion 26 of the central column 14, for a gardener to apply foot pressure thereto for planting the lower portion 26 of the central column 12 in the ground G. Preferably, the foot planting crossmember 32, the tool rest crossmember 14, the spade or blade 30, and the optional top crossmember 22 are all affixed to the central column 12 in a coplanar relationship, to provide a relatively narrow configuration for the present tool rest 10 for compact storage thereof when not in use. The top plan view of FIG. 3 clearly shows the coplanar relationship between at least the tool rest crossmember 14 and the spade or blade bit 30; the top and foot planting crossmembers 22 and 32 are not shown in FIG. 3, for clarity in the drawing FIGURE.

Figure 3:
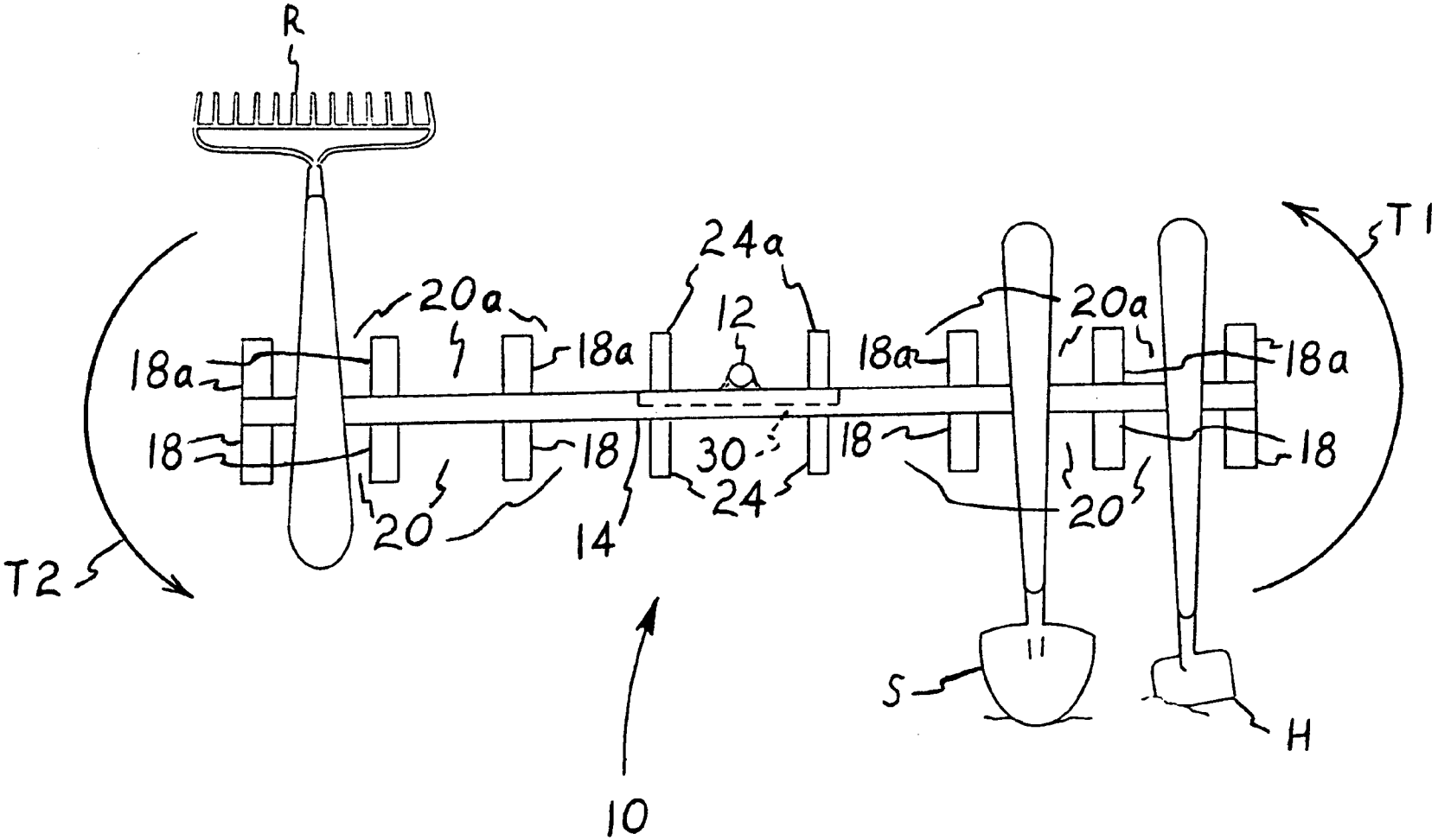
FIG. 3 is a top plan view of the present garden tool rack, showing further details thereof and the torsional structural rigidity provided by the configuration of the rack.

FIG. 3 also clearly shows the asymmetric torque or rotational forces which may be applied to the present tool rack 10, when larger tools are leaned thereagainst. In FIG. 3, a hoe H and shovel S have been leaned against the two outermost tool rest positions 20 to the right side of the tool rack 10. The force of the two handles of the hoe H and shovel S leaning against the tool rest crossmember 14 will be seen to produce a counterclockwise torque upon the central column 12, as indicated by the torque arrow T1 adjacent the hoe H and shovel S. In a similar manner, the rake R leaning against the outermost tool rest position 20*a* to the left side of the tool rack 10 results in a second counterclockwise torque, as indicated by the torque arrow T2 adjacent the rake R.

These two torques T1 and T2 are acting in the same direction of rotation, i.e., urging the tool rest crossmember 14 to rotate the central column 12 in a counterclockwise direction. With the relatively narrow diameter of the lower portion 26 of the central column 12, the tool rack 10 might turn or revolve somewhat within the corresponding hole in the ground, due to the relatively long moment arm provided by the crossmember 14 relative to the diameter of the central column 12. However, the rigidly affixed spade bit or blade 30, secured to the lower portion 26 of the column 12 and engaging the ground G, provides more than adequate rotational resistance for the attached column 12, thereby precluding rotation of the tool rack 10 when any practicable number or arrangement of tools is leaned thereagainst.

The present portable rack 10 is preferably constructed of solid steel rod and with all of its components being rigidly welded together to form a single, unitary, rigid structure, with none of the parts or components being movable relative to one another. (Other materials, e.g., heavy walled pipe stock, square stock, angle iron, etc., may be used, so long as the rigidity and solidity of the structure is maintained.) Thus, the rotational immobility of the spade or blade bit when sunk into the ground, precludes rotation of the central column 12 and thus all other components (e.g., the tool rest crossmember 14, etc.) of the present tool rest or rack 10.

In summary, the present portable rack for garden tools provides a much needed convenient rest or support for larger hand tools (shovels, rakes, hoes, etc.) which may be leaned thereagainst, thereby precluding any requirement that a gardener stoop or bend to pick up such tools placed upon the ground. The present rack may be constructed in any number of sizes as desired, from the approximately five foot height shown in FIG. 1, to shorter heights for the support of smaller tools, as desired. The present rack may also serve for the support of other articles as 10 desired, e.g., for the storage of tack or harness equipment in a horse barn, or planted in a field to serve as the frame for a scarecrow. However, the primary function of the present rack is to serve as a portable tool rack for gardening and landscaping hand tools, as shown in the drawing Figures. Accordingly, the device may be painted or otherwise coated with a bright, easily visible coating (red, etc.) which serves to rustproof the structure as well, protecting it from the outdoor environment. The result is a tool rack which will serve the gardener well for a number of years, providing an efficient and cost effective means of supporting tools and easing the work of the gardener.

It is to be understood that the present invention is not limited to the embodiments described above, but encompasses any and all embodiments within the scope of the following claims.

I claim:

1. A portable rack for garden tools, comprising:

a rigid, straight central column having a lower portion for removably anchoring in the ground and an upper portion opposite said lower portion;

a rigid, straight, elongate tool rest crossmember extending laterally across said upper portion of said central column;

a plurality of spaced apart tool rest fingers extending laterally from said tool rest crossmember;

said fingers defining a plurality of tool rest positions for leaning elongate tool handles thereagainst; and a rigid, straight, elongate top crossmember affixed to said upper portion of said central column above said tool rest crossmember.

2. The rack according to claim 1, comprising a rigid, unitary, monolithic structure with at least said central column, said tool rest crossmember, and said tool rest fingers each being formed of steel and being rigidly welded together.

3. The rack according to claim 1, wherein said lower portion of said central column includes a sharpened lower end for facilitating ground penetration of said lower portion of said central column.

4. The rack according to claim 1, including a spade bit immovably affixed to and laterally extending from said lower portion of said central column, for removably imbedding in the ground for precluding rotation of said central column relative to the ground.

5. The rack according to claim 4, including a straight, elongate, rigid foot planting crossmember immovably affixed to and extending across said lower portion of said central column above said spade bit, for applying foot pressure thereto for planting said lower portion of said central column in the ground.

6. The rack according to claim 1, including at least one secondary support finger for suspending a tool therefrom, with said at least one secondary support finger having a smaller diameter than said tool rest fingers.

7. The rack according to claim 1, wherein said tool rest fingers are symmetrically disposed relative to said tool rest crossmember and extend substantially equally to each side thereof.

8. The rack according to claim 1, including a laterally extending flat spade bit affixed to said lower portion of said central column, a straight, elongate, rigid foot planting crossmember immovably affixed to and extending across said lower portion of said central column above said spade bit, said tool rest crossmember, said spade bit, said foot planting crossmember, and said top crossmember each being disposed coplanar with one another.

9. The rack according to claim 1, including a bright, rust resistant coating disposed completely thereover.

10. A portable rack for garden tools, comprising:

a rigid, straight central column having a lower portion and an upper portion opposite said lower portion;

a rigid, straight, elongate tool rest crossmember extending laterally across said upper portion of said central column;

a plurality of spaced apart tool rest fingers extending laterally from said tool rest crossmember;

said fingers defining a plurality of tool rest positions for leaning elongate tool handles thereagainst;

a rigid, straight, elongate top crossmember affixed to said upper portion of said central column above said tool rest crossmember; and at least said central column, said tool rest crossmember, and said plurality of tool rest fingers comprising a rigid, unitary, monolithic structure formed of rigidly welded steel.

11. The rack according to claim 10, including ground penetration means disposed upon said lower portion of said central column for removably anchoring said central column in the ground.

12. The rack according to claim 11, wherein said ground penetration means includes a sharpened lower end for facilitating ground penetration of said lower portion of said central column.

13. The rack according to claim 11, wherein said ground penetration means includes a spade bit immovably affixed to and laterally extending from said lower portion of said central column, for removably imbedding in the ground for precluding rotation of said central column relative to the ground.

14. The rack according to claim 13, including a straight, elongate, rigid foot planting crossmember immovably affixed to and extending across said lower portion of said central column above said spade bit, for applying foot pressure thereto for planting said lower portion of said central column in the ground.

15. The rack according to claim 10, including at least one secondary support finger for suspending a tool therefrom, with said at least one secondary support finger having a smaller diameter than said tool rest fingers.

16. The rack according to claim 10, wherein said tool rest fingers are symmetrically disposed relative to said tool rest crossmember and extend substantially equally to each side thereof.

17. The rack according to claim 10, including a laterally extending flat spade bit affixed to said lower portion of said central column, a straight, elongate, rigid foot planting crossmember immovably affixed to and extending across said lower portion of said central column above said spade bit, said tool rest crossmember, said spade bit, said foot planting crossmember, and said top crossmember each being disposed coplanar with one another.

18. The rack according to claim 10, including a bright, rust resistant coating disposed completely thereover.

* * * * *